United States Patent [19]

Smith

[11] 4,067,206

[45] Jan. 10, 1978

[54] CONDENSATE EVAPORATION SYSTEM FOR AIR CONDITIONERS

[75] Inventor: Hayden N. Smith, Galesburg, Ill.

[73] Assignee: Admiral Corporation, Schaumburg, Ill.

[21] Appl. No.: 723,374

[22] Filed: Sept. 15, 1976

[51] Int. Cl.[2] ..... D01D 47/16; C10J 1/18; F24F 3/14

[52] U.S. Cl. ..... 62/280; 261/84

[58] Field of Search ..... 62/279, 280; 261/84; 239/219, 221

[56] References Cited

U.S. PATENT DOCUMENTS

| | | | |
|---|---|---|---|
| 2,219,826 | 10/1940 | Swinburne et al. | 62/280 |
| 2,776,554 | 1/1957 | Pigman | 62/280 |
| 2,793,510 | 5/1957 | Komroff et al. | 62/280 |
| 3,763,660 | 10/1973 | Burney | 62/280 |
| 3,811,293 | 5/1974 | Flynn | 62/280 |
| 3,872,684 | 3/1975 | Scott | 62/280 |

*Primary Examiner*—Lloyd L. King

[57] ABSTRACT

A system for evaporating condensed moisture in an air conditioner includes an axial flow fan having an annular slinger ring which rotates through a sump in which moisture condensed at the evaporator collects, the slinger ring entraining moisture during rotation therethrough and centrifugally discharging the moisture upwardly along the side wall of the air conditioner housing, at increasing heights as the moisture level in the sump increases, the moisture flowing downwardly along the wall and being collected by a reservoir to which a conduit is connected for conveying and discharging the moisture at a lower elevation interior of the fan air stream so as to direct the moisture onto the condenser for evaporation thereat.

4 Claims, 4 Drawing Figures

CONDENSATE EVAPORATION SYSTEM FOR AIR CONDITIONERS

BACKGROUND OF THE INVENTION

The present invention relates to a system for evaporating condensed moisture and, in particular, a condensate evaporation system for an air conditioner having moisture conveying means for improving the evaporative performance of the system.

A basic function of air conditioners, in addition to removing sensible heat, involves removing moisture from the conditioned air. The moisture from the air is condensed at the evaporator and then drained to the outdoor or condenser side of the unit. Considerable energy is expended to achieve this condensing, which is then partially recovered by evaporating the moisture on the condenser. Additionally, in high humidity environments where the moisture condensation rate is high, such evaporation systems avoid the additional expense associated with separate condensate drainage systems.

One of the more common prior art approaches for condensate evaporation is to provide a slinger ring on the condenser fan which directs air flow across the condenser. The slinger ring rotates through the condensate accumulated from the evaporator side and, depending on the water level therein, entrains moisture during rotation and centrifugally throws the moisture outwardly in a plane normal to the plane of rotation. However, inasmuch as the condenser lies in a plane parallel to the plane of rotation, only a small portion of the pumped condensate is effectively transferred to the condenser for reevaporation. As a result, the system is unable to keep up with the moisture volume when humidity is high and thus the system is either allowed to overflow in order to avoid fan motor stall or an oversized motor is provided in excess of that required to satisfy air flow needs. Other approaches have involved the use of various baffles and deflectors, the intent of which is to direct the condensate into the vortex of the condenser fan thereat. The relatively low pressure of the center of the vortex causes some of the water to percolate up to the airstream for redirection into air flow and onto the condenser for evaporation. However, in this system as in the slinger system, high humidities and water levels are not adequately handled.

SUMMARY OF THE INVENTION

The present invention provides a new and improved method for disposing of the water condensed by the evaporator having a greatly improved ratio of water delivered to the condenser to the total water pumped. Moreover, the present invention provides a system where total water pumped increases with increasing humidities and water levels in a manner that prevents overflow at much higher humidity levels than conventional designs and, in so doing, conserves energies at these higher humidities. More particularly, the present invention incorporates a conventional slinger ring on condenser fan that rotates through the accumulated water and, at low humidities and water levels, centrifugally throws a fine spray of condensate in all directions in a plane containing the slinger ring. As the humidity increases, the water level on the slinger ring increases and a large, uncontained column of water is centrifugally discharged upwardly alongside the wall of the housing normal to the plane of rotation. The height and size of the water column increases with increased water levels. This feature, common to all slinger ring systems, is advantageously developed into an improved evaporation system by means of a reservoir on the side wall which collects the downwardly flowing pumped water. By means of a conduit leading from the reservoir and discharging into the fan vortex at a lower elevation than the reservoir, water is delivered on the fan blades resulting in a significant percentage of the water being thereby atomized and carried by the airstream directly onto the condenser for evaporation.

Such an improved system provides a large improvement in the water delivered to the condenser to the total water pumped ratio such that, for comparable motor torques, the water evaporation rate is greatly increased thereby avoiding dripping and overflowing at higher humidites. For comparable evaporating rates, much less total water is pumped thereby allowing the fan motor torque to be reduced. Performance of the system may also be advantageously improved by using various baffles to insure that increased amounts of water are directed into the reservoir and the available water level adjacent the slinger ring is maintained to maintain the slinger pumping rate.

The above and other features of the present invention will be apparent to those skilled in the art upon reading the following detailed description, reference being made to the accompanying drawings illustrating a preferred embodiment in which:

DESCRIPTION OF THE INVENTION

Figure 1:
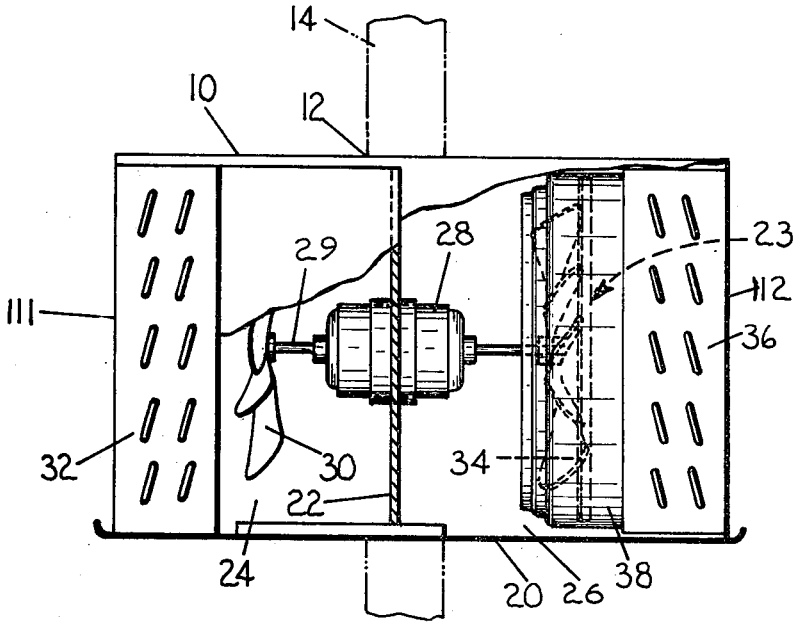
FIG. 1 is a diagrammatic view of an air conditioner incorporating a condensate evaporation system in accordance with the present invention.

Referring to FIG. 1 there is shown a room air conditioner 10 mounted within a rectangular opening 12 in a wall or window 14, such that the left hand side 111 thereof is disposed in a room in which the air is to be conditioned and the right hand side 112 is exposed to the outside environment.

The air conditioner 10 comprises a housing 20 having a median bulkhead 22 which divides the unit into an evaporator compartment 24 and a condenser compartment 26. An electric motor 28 supported on the bulkhead 22 has a dual output shaft 29, the left hand end of which is connected to an evaporator fan 30 for directing axial airstream over the cooling coils of an evaporator unit 32 and the right hand end of which is connected with the condenser fan 34 for directing an axial airstream over the cooling coils and fins of a condenser unit 36.

In operation, the evaporator unit 32 condenses moisture from the room air for collection in a sump (not shown) in the evaporator compartment 24. By means of conduits or other passageways, the condensate thus collected is directed to the condenser compartment 26 and establishes in a condenser sump a water level 38 in the region of the condenser fan 34. Depending upon the environment in which the air conditioner 10 is operating, the water level increases or decreases in accordance with the humidity.

Figure 2:
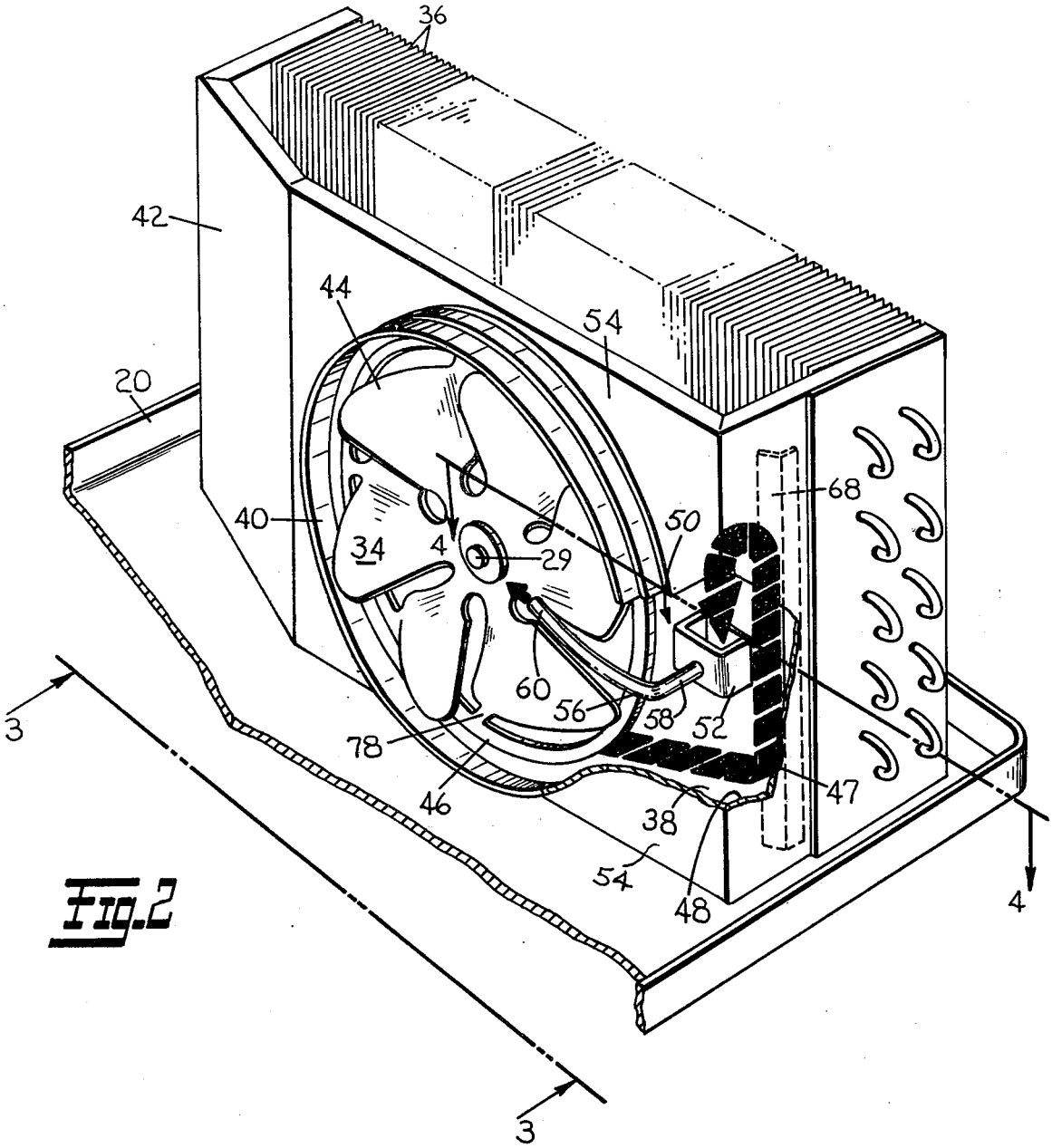
FIG. 2 is an enlarged partial perspective view showing the condenser, the condenser fan and slinger ring pumping a column of water, illustrated by the arrows, onto the air conditioner side wall for collection and conveyance in accordance with the invention.

Referring to FIG. 2, the condenser fan 34 is disposed within air inlet ring 40 of a transverse shroud 42 which is operative to force the air delivered by the fan 34 through the condenser unit 36. The fan 34 includes a plurality of radially extending flow blades 44 to which an annular slinger ring 46 is attached to the ends thereof at spaced circumferential ribs 78. Upon rotation of the fan 34, the blades are operative to direct an axial vortex air flow onto the condenser unit 36. The slinger ring 46 rotates through the collected condensate or water in accordance with the prevailing water level and directs a water column 47 as shown by the blocked arrows centrifugally outwardly thereof and upwardly along side wall 48. The side wall 48 is disposed in a plane normal to the plane containing the slinger ring 46. The pumped water flows upwardly in elevation dependent on its potential energy and, in general, a higher elevation as the water level increases. In prior art systems, the pumped water then flows downwardly along the wall for return to the sump. During this time a nominal portion of pumped water is atomized and directed onto the condenser by the fan airstream. However, the ratio of the water delivered to the condenser to the total water pumped is extremely low.

Figure 3:
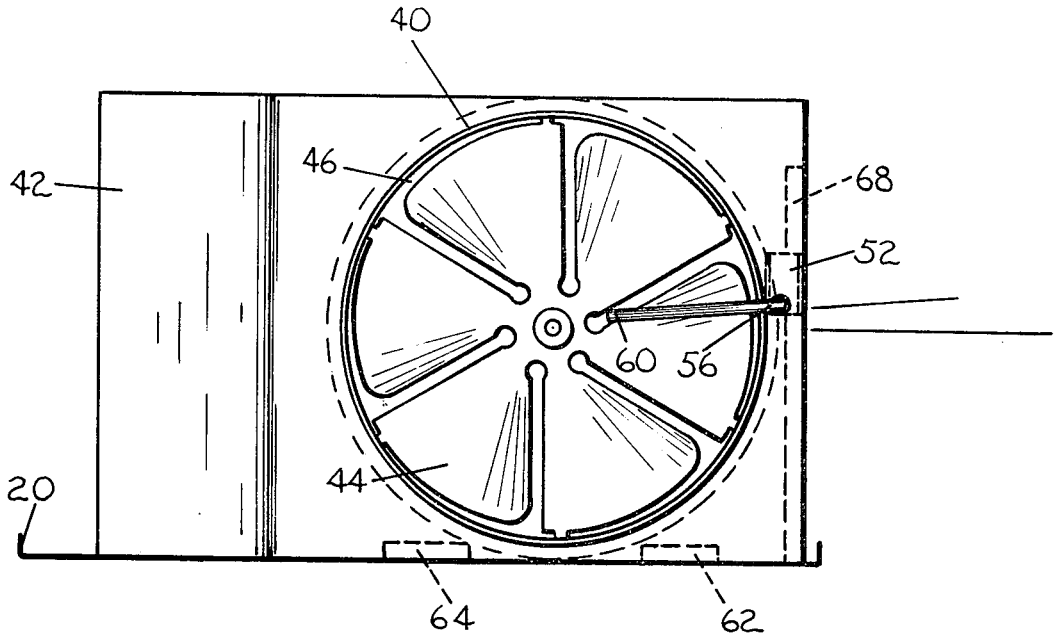
FIG. 3 is a view taken along line 3—3 of FIG. 2 showing the disposition of condensate collection and delivery system with respect to the fan.
Figure 4:
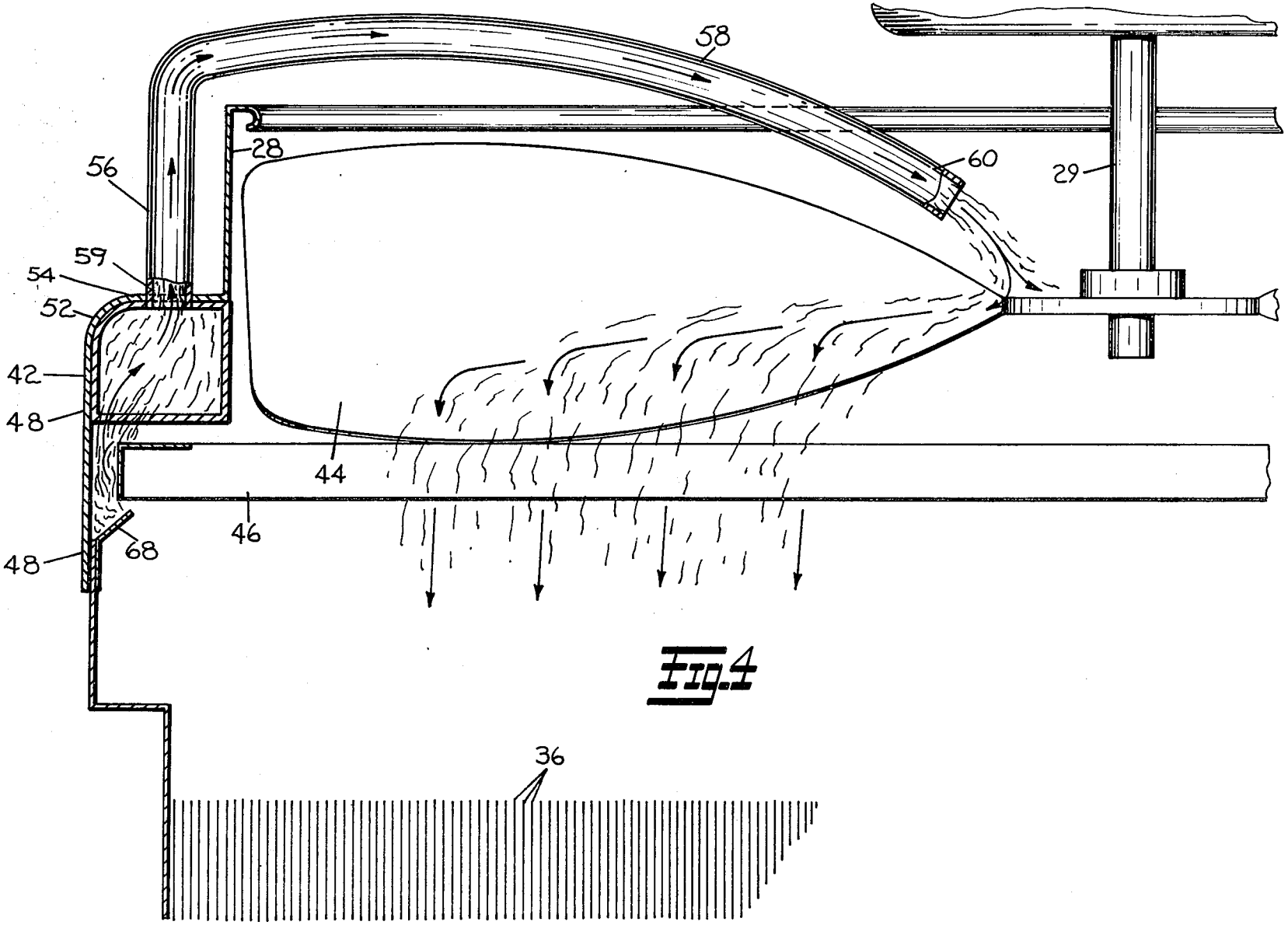
FIG. 4 is a view taken along line 4—4 of FIG. 2 showing the flow of condensate collected in the reservoir through the conveying conduit into the fan vortex for direction by the fan airstream onto the condenser.

To greatly increase the ratio of water delivered to the condenser to total water pumped, a condensate collection and delivery assemble 50 is provided. More particularly the water column 47 flows downwardly into an upwardly opening reservoir 52 mounted on the side wall of the shroud 42. The reservoir 52 is generally rectangular and has a side wall fixed to the front wall 54 of the shroud 42. A delivery pipe 56 of the assembly 50 includes a leg 58 which projects through a hole in the front wall and has an inner end 59 fluidly communicating with the interior of the reservoir 52. The pipe 56 has a curved outer end 58 extending along and into the air inlet shown in FIGS. 3 and 4. The outlet 60 of the pipe 56 is at a lower elevation than the inlet and discharges adjacent the inner periphery of the blades 44 interior of the flow vortex thereof. The lower elevation of the discharge and/or the pressure differential between the reservoir and the area adjacent outlet 60 causes the collected water to flow therethrough for discharge into the flow vortex as generally indicated by the flow lines on FIG. 4. This causes the water to be atomized and directed along with the airstream for impingement on the condensing tubes and fins for evaporation thereat and energy recovery as a result thereof. However, it should be noted that the negative pressure at the outlet 60, the positive pressure in the compartment 26 and the pressure head in the reservoir 52 are additive such that the system will operate with the inlet lower than outlet so long as a positive pressure differential exist between inlet 59 and outlet 60.

In the preferred embodiment, discharge is slightly above the axis of rotation of the fan and slightly radially outwardly of the inner operational surfaces of the fan blade. This results in a greater radial dispersion of the moisture into the airstream and a centrifugal carrying therealong.

Further improved performances can be provided by providing baffles along the base fan in the area of the slinger ring. These baffles 62 and 64 still the water level from the air flow to prevent it from being locally depressed thereat so as to lower the effective water level exposed to the slinger ring 46. Further, an outwardly turned vertically extending baffle 68 can be provided along the side wall 48 of the shroud 42. This baffle configuration will serve to direct the water column forwardly such that a greater downflow will be directed into the reservoir 52.

Testing has shown that the above construction with the above affirmative collection and delivery system will evaporate considerably greater amounts of water than the mere slinger construction alone. In this connection, an air conditioning unit with only the slinger that handles an 80% relative humidity environment per ANSI specification Z234.1, Paragraph 6.10, will handle a 90% relative humidity environment when provided with the present invention.

While the present invention has been described with respect to conventional units, the same is also applicable to split air conditioning systems in that the water conventionally drained from the indoor evaporator plenum can be pumped or drained into the outdoor condensing unit. Further, tap or other waste residential water could be drained, stored and supplied to the condensing unit where evaporation as herein disclosed provides a significant reduction in energy consumption inasmuch as sufficient pumping capacity is available for such purposes.

Although only one form of this invention has been shown and described, other forms will be readily apparent to those skilled in the art. Therefore, it is not intended to limit the scope of this invention by the embodiments selected for purposes of this disclosure, but only by the claims which follows.

What is claimed is:

1. A moisture evaporation system for an air conditioner having a housing and a condenser, an axial flow fan to the side for directing an airstream onto the condenser, and a sump adjacent the fan in which moisture collects; said system comprising:

an annular slinger ring on the periphery of the fan rotating through the moisture in the sump and centrifugally discharging the moisture from the sump upwardly along a wall of the housing; a reservoir on the wall for collecting moisture flowing downwardly along the wall, and a conduit having an inlet at the reservoir and an outlet discharging moisture interior of the airstream and upstream of the fan whereby the moisture is atomized and carried by the airstream for evaporation at the condenser.

2. The system recited in claim 1 wherein first baffle extends along the wall of the housing and is operative for directing the moisture flowing downwardly toward the reservoir.

3. The system recited in claim 2 wherein a second baffle is positioned in the sump and is operative to stabilize the water level during operation of the fan.

4. In an air conditioner having a housing including an evaporator amd a condenser, means for conveying moisture condensed by the evaporator to a sump at the condenser, and a fan having a plurality of radial blades for directing an axial airstream onto the condenser, and a shroud surrounding the fan and defining an inlet for the airstream, a moisture evaporation system comprising:

an annular slinger ring connected to the ends of the blades rotatable through the sump, said slinger ring entraining moisture thereon and centrifugally discharging the moisture upwardly along the end wall; an upwardly opening reservoir on the shroud for collecting moisture flowing downwardly along the wall, said reservoir being at an elevation partially above the airstream; a conduit having an inlet at the reservoir and extending upstream of the shroud and having an outlet interior of the shroud at a lower elevation than the conduit inlet but also partially above the airstream and adjacent the inner ends of the blade for discharging condensate flowing through the conduit interior of the airstream and upstream the fan whereby the fan discharges the moisture to the airstream for delivery to and evaporation at the condenser.

* * * * *

UNITED STATES PATENT AND TRADEMARK OFFICE

CERTIFICATE OF CORRECTION

PATENT NO. : 4,067,206

DATED : January 10, 1978

INVENTOR(S) : Hayden N. Smith

It is certified that error appears in the above-identified patent and that said Letters Patent are hereby corrected as shown below:

In column 3, line 33, after "delivery" delete "assemble" and insert --assembly--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*